United States Patent [19]

Kaiser

[11] Patent Number: 4,983,221

[45] Date of Patent: Jan. 8, 1991

[54] BUFFING PAD CLEANING METHOD AND APPARATUS

[76] Inventor: Richard A. Kaiser, 7083 Main St., Merton, Wis. 53056

[21] Appl. No.: 481,317

[22] Filed: Feb. 20, 1990

[51] Int. Cl.[5] ..... A47L 25/00

[52] U.S. Cl. ..... 134/6; 15/1; 15/3; 15/104.92

[58] Field of Search ..... 15/1, 3, 104.92, 142, 15/89; 134/6, 16

[56] References Cited

U.S. PATENT DOCUMENTS

| | | | |
|---|---|---|---|
| 2,877,479 | 3/1959 | Hermance | 15/142 X |
| 3,608,120 | 9/1971 | Seiler | 15/104.92 X |
| 4,786,333 | 11/1988 | Kaiser | 15/3 X |

*Primary Examiner*—Paul T. Sewell
*Assistant Examiner*—Ted Kavanaugh
*Attorney, Agent, or Firm*—James L. Kirschnik

[57] ABSTRACT

A method and apparatus for cleaning buffing pads includes a hollow cleaning enclosure for receiving the pad while still attached to the buffing machine and permitting rotation of the pad within the enclosure. Agitating members are provided to contact the buffing pad while cleaning solutions are injected into the enclosure and against the buffing pad face while rotating. A pump drive wheel driven by the rotating buffing pad provides power to drive a pump contained within a reservoir of cleaning fluid to pump the cleaning fluid to the enclosure and pad.

14 Claims, 2 Drawing Sheets

BUFFING PAD CLEANING METHOD AND APPARATUS

BACKGROUNG OF THE INVENTION

1. Field of the Invention

This invention relates to devices for cleaning buffing pads of the type commonly used on power buffers by automotive body shops.

2. Description of the Prior Art a method and apparatus for cleaning buffing pads is described in my U.S. Pat. No. 4,786,333 issued Nov. 22, 1988. The device shown and described utilizes a container for receiving a buffing pad while attached to a buffing maching. Agitating wheels are provided for contacting the buffing pad face. A power driven pump and fluid reservoir is provided for directing cleaning fluid against the face of the buffing pad while rotating against the agitator wheels to aid in the cleaning process. A disadvantage of the pad cleaning device described in my patent is the use of an external power source to power the pump motor for circulating the cleaning fluid. Because of a lack of uniformity of electrical voltage and alternating current cycles in various countries of the world, a single pump motor suitable for universal use is not possible, as the specific characteristics of power supplies available at locations where the device may be used would dictate the type of pump motor required.

SUMMARY OF THE INVENTION

It is an object of the present invention to provide an improved buffing pad cleaning method and apparatus in which the motion of a buffing pad while being rotated on a buffing machine is used to power the pump for circulating cleaning fluid.

The subject invention provides for a buffing pad cleaning apparatus substantially as described in my U.S. Pat. No. 4,786,333 issued Nov. 22, 1988. The improvement consists of providing a pump drive wheel positioned within the container and adapted to be rotated by contact with a rotating buffing pad within the container. The drive wheel in turn rotates the impeller of a pump placed within a cleaning fluid reservoir to pump cleaning fluid to the buffing pad face during rotation. A simple shut off lever is provided for selectively preventing fluid circulation to the buffing pad despite the continued rotation of the buffing pad.

DESCRIPTION OF A PREFERRED EMBODIMENT

Figure 1:
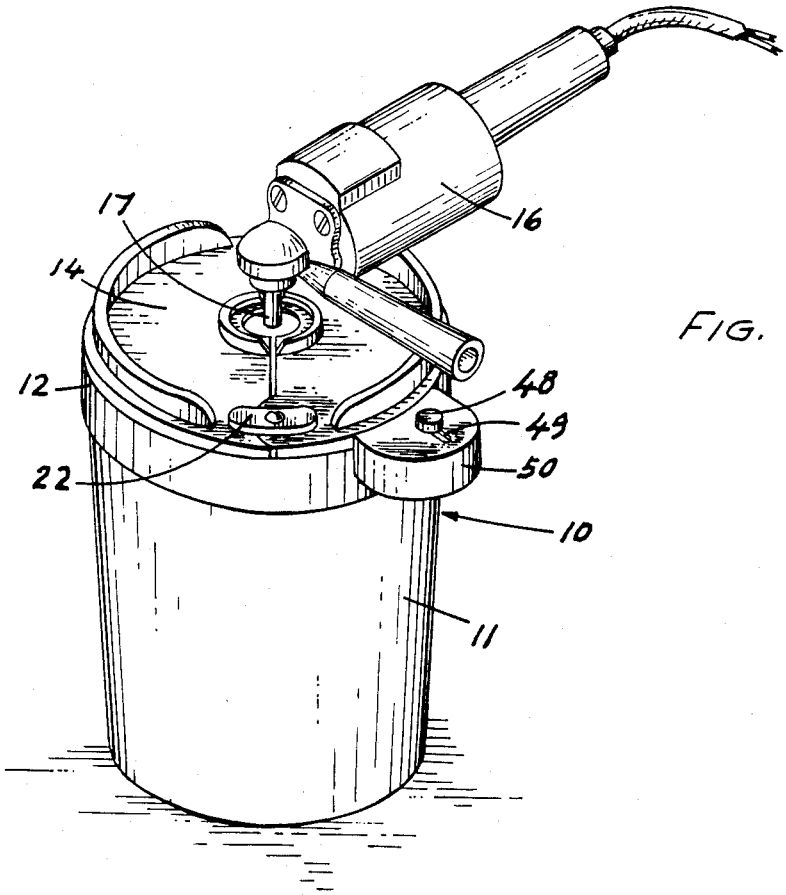
FIG. 1 is a perspective view of a buffing pad cleaning device according to the invention.
Figure 2:
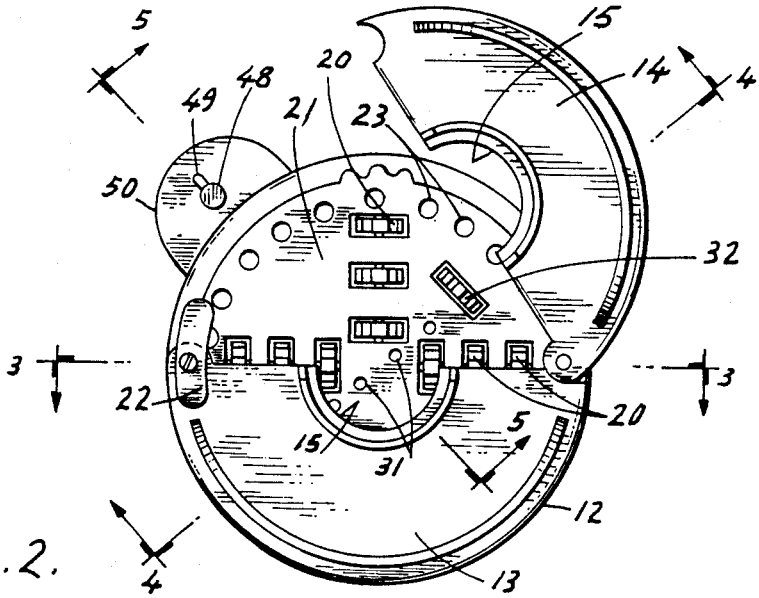
FIG. 2 is a top view fo the buffing pad enclosure with a portion of the cover open.
Figure 3:
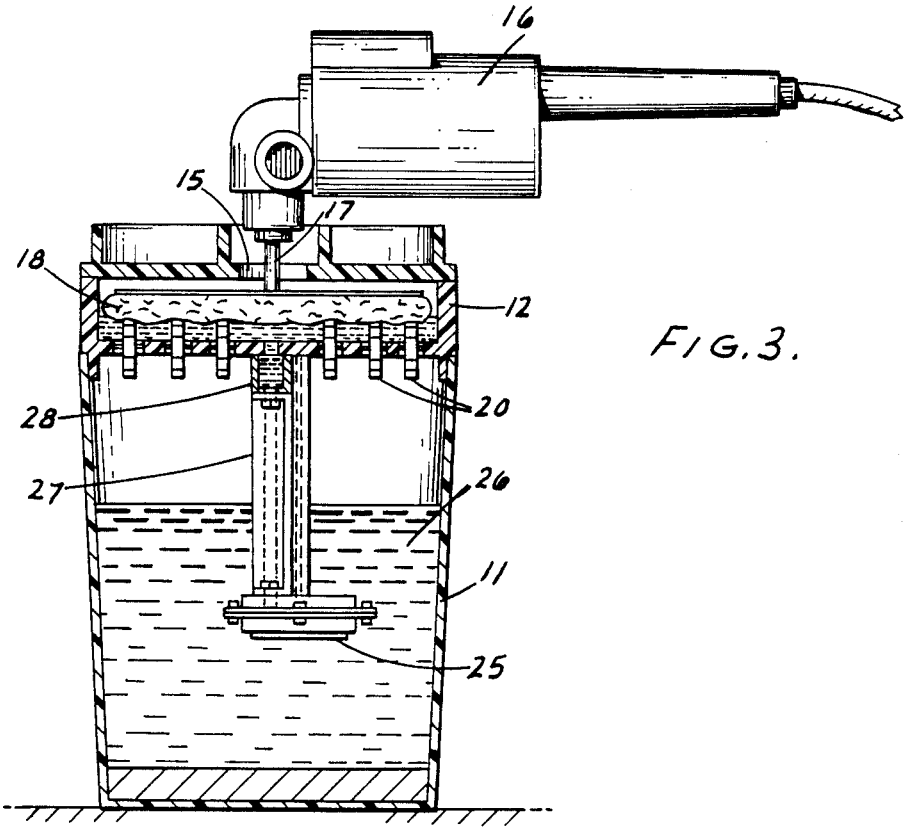
FIG. 3 is a view taken along line 3—3 of FIG 2 in combination with a buffing machine.

As seen in FIGS. 1, 2, and 3, the buffing pad cleaning apparatus 10 includes a fluid reservoir 11 and a hollow pad cleaning enclosure 12 placed at the top of the reservoir. A cover consisting of a stationary half 13 and pivotable second half 14 is provided to permit insertion of a buffing pad into top of the enclosure 12. A central aperture 15 is formed within the two cover halves 13 and 14 when they are closed to permit a buffing machine 16 to be positioned above the cover while its drive shaft 17 extends through the central aperture 15 with an attached buffing pad 18 positioned within the cleaning enclosure 12.

A purality of vertically upstanding rotatable agitator wheels 20 are mounted in the bottom 21 of enclosure 12. The wheels are mounted on axes extending generally radially from the center of the cleaning enclosure 12 and are positioned at varying radial distances within the enclosur so as to contact different portions of the surface of the buffing pad 18. A cover latch assembly 22 is provided for keeping the cover closed and a plurality of drain holes 23 are provided for permitting drainage of cleaning fluid back into the reservoir 11. All of these features are similar to those more particularly described in my U.S. Pat. No. 4,786,333.

Figure 4:
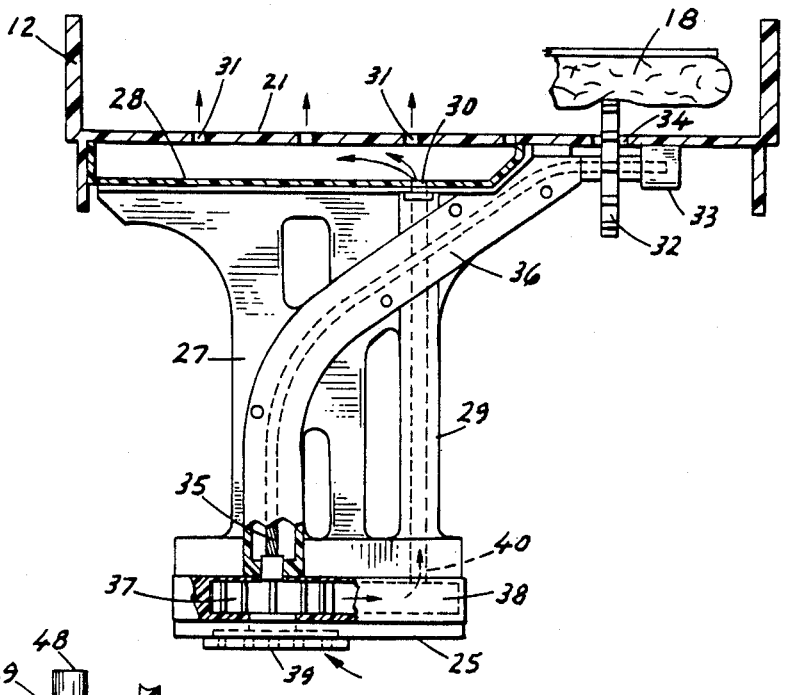
FIG. 4 is a partial section view taken along line 4—4 of FIG. 2.

As is best seen in FIGS. 3 and 4, a pump 25 is positioned within the cleaning fluid 26 in the reservoir 11 and is coupled to the cleaning enclosure by a column-like support structure 27 attached at its upper ent to a fluid manifold 28 affixed to the lower surface of the enclosure bottom 21. The support structure 27 includes a hallow wash column 29 with its interior adjoining a fluid entry aperture 30 formed in the manifold 28. A pluarality of fluid disbursing apertures 31 are provided in the enclosure bottom 21 to interconnect the interior of the manifold with the interior of the enclosure 12. A rotatable drive wheel 32 is journaled in a mounting block 33 with the wheel's central axis extending generally radially from the center of the enclosure 12. A portion of the drive wheel 32 extends upward into the interior of the enclosure through a slot 34, and a flexible drive cable 35 is coupled to the center of the drive wheel 32 and extends downwardly within a hollow cable housing 36 formed in the support structure 27 and terminating at the center of a pump impeller 37 within a housing 38 of pump 25. Rotation of drive wheel 32 will thus rotate the drive cable 35 and impeller 37. A perforated inlet screen 39 is provided on the pump housing where the impeller is mounted to permit fluid to be drawn through the screen 39 and pumped by rotation of the impeller 37 through a passage 40 connected to the interior of the hollow wash column 29 whereby fluid will be drawn from the reservoir 11, and pumped upward to the manifold 28 for injection against the face of the buffing pad 18 through apertures 31. Thus, no external power source other than the power to the buffing machine 16 itself is required to provide circulation and pumpimg of the cleaning fluid. Excess fluid collected within the enclosure drains back to the reservoir through the apertures 23.

Figure 5:
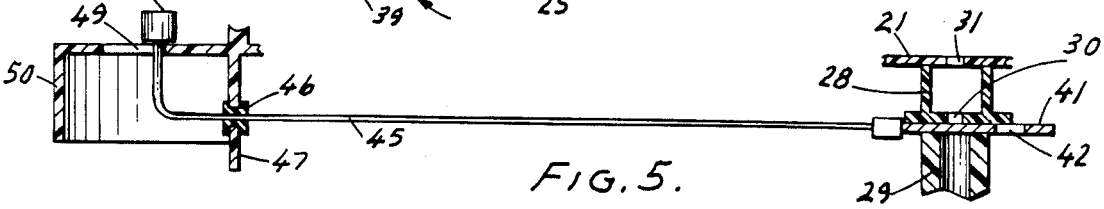
FIG. 5 is a partial section view taken along line 5—5 of FIG. 2.

As seen in FIG. 5, a cut-off of fluid flow to the manifold 28 is provided by means of a flat sliding plate 41 positioned between the end of the hollow column 29 and the aperture 30 leading to the manifold 28. The plate 41 has an aperture 42 formed therein which may be aligned with the interior of the hollow wash column 29 and aperture 30 to permit fluid flow with the plate in a first or open position. With the plate in a second or closed position, flow is blocked between the wash column 29 interior and aperture 30. A movable control linkage 45 extends from one end of the plate outwardly through a block 46 and through the exterior wall 47 of the enclosure 12 with the linkage coupled at its opposite end to a control button 48 mounted in a slot 49 in a projecting control section 50 attached to the outer perimeter of the enclosure 12. Sliding the button 48 back and forth permits the plate 41 to be positioned to either permit fluid flow or terminate fluid flow even while the buffing pad continues to operate and drive the drive wheel 34. This feature permits discontinuance of flow after cleaning has been completed and allows the buffing pad 18 to continue to spin and drive off excess fluid within the pad 18 while avoiding the introduction of more fluid onto it.

As will thus be appreciated by those skilled in the art, the present invention provides an improved apparatus for cleaning buffing pads in which a fluid circulating pump is provided but which is driven solely by the power of the buffing machine rather than any external power source such as a pump motor. In practice, the perferred construction of the pump and supporting components are plastic or similar synthetic materials because of their resistance to corrosion. Where metal parts are used such as mounting screws, brackets, the pump screen, drive cable, and shut-off plate, stainless steel or other corrosion resistant metals are preferable. Those skilled in the art will appreciate that different variations of the device may be possible without departing from the scope or intent of the invention. For example, instead of a flexible cable, a series of shafts and gears could be used to power the pump impeller if suitably connected to the drive wheel. Other variations will also be apparent to whose skilled in the art. Accordingly, the scope of the invention is to be taken solely from an interpretation of the claims which follow.

I claim:

1. Apparatus for cleaning power driven buffing pads having a buffing face portion while the pads are mounted on a buffing machine comprising:

a. hollow enclosure means for receiving and containing a buffing pad while attached to a buffing machine and permitting rotation of the same within said enclosure means;

b. agitator means mounted within said enclosure for contacting the face of said buffing pad;

c. a reservoir for containing cleaning fluid coupled to said enclosure means;

d. pump means supported within said reservoir for pumping cleaning fluid into said enclosure means and into contact with said buffing pad during rotation;

e. drive means mounted within said enclosure means positioned to co-act with said rotatable buffing pad and adapted to power said pump means under the influence of rotation of said buffing pad.

2. Apparatus as set forth in claim 1 including shut-off means for selectively controlling the flow of fluid from said pump to said enclosure means.

3. Apparatus as set forth in claim 2 wherein said drive means comprises:

a. a rotatable wheel positioned to contact the face of said buffing pad; and, b. means for connecting said rotatable wheel to a pump impeller whereby rotation of said rotatable wheel will cause rotation of said impeller.

4. Apparatus as set forth in claim 3 wherein said drive means comprises a flexible drive cable.

5. Apparatus as set forth in claim 4 wherein said pump means is suspended form said enclosure means into said reservoir and cleaning fluid.

6. Apparatus as set forth in claim 5 including support means for supporting said pump means within said reservoir, said support means including a hollow passageway for connecting an outlet of said pump means to a manifold for distributing cleaning solution into said enclosure means and against said buffing pad.

7. Apparatus as set forth in claim 6 wherein said shut-off means includes means for selectively interrupting the flow of fluid through the hollow passageway within said support means.

8. Apparatus as set forth in claim 1 wherein said drive means comprises:

a. a rotatable wheel positioned to contact the face of said buffing pad; and, b. means for connecting said rotatable wheel to a pump impeller whereby rotation of said rotatable wheel will cause rotation of said impeller.

9. Apparatus as set forth in claim 8 wherein said drive means comprises a flexible drive cable.

10. Apparatus as set forth in claim 1 wherein said pump means is suspended from said enclosure means into said reservoir and cleaning fluid.

11. Apparatus as set forth in claim 10 including support means for supporting said pump means within said reservoir, said support means including a hollow passageway for connecting an outlet of said pump means to a manifold for distributing cleaning solution into said enclosure means and against said buffing pad.

12. Apparatus as set forth in claim 2 wherein said shut-off means icludes means for selectively interrupting the flow of fluid through the hollow passageway within said support means.

13. A method of cleaning a buffing pad while mounted on a buffing machine comprising the steps of:

a. inserting a buffing pad mounted on said buffing machine into a hollow cleaning enclosure;

b. rotating said buffing pad within said enclosure while in contact with a plurality of agitating devices contained within said enclosure in contact with said buffing pad;

c. using rotation of said buffing pad within enclosure to drive a pump positioned within a fluid reservoir of cleaning solution;

d. pumpinp cleaning solution in to contact with said buffing pad while rotating it in said enclosure.

14. A method as set forth in claim 13 including the step of selectively controlling the flow of fluid from said pump to said enclosure.

* * * * *